US008529280B2

(12) United States Patent
Lim

(10) Patent No.: US 8,529,280 B2
(45) Date of Patent: Sep. 10, 2013

(54) ELECTRICAL ENGAGEMENT APPARATUS, SYSTEM AND METHOD

(75) Inventor: Chin Hua Lim, Singapore (SG)

(73) Assignee: 3M Innovative Properties Company, St. Paul, MN (US)

( * ) Notice: Subject to any disclaimer, the term of this patent is extended or adjusted under 35 U.S.C. 154(b) by 319 days.

(21) Appl. No.: 12/995,743

(22) PCT Filed: May 12, 2009

(86) PCT No.: PCT/US2009/043522

§ 371 (c)(1),
(2), (4) Date: Dec. 2, 2010

(87) PCT Pub. No.: WO2009/148770

PCT Pub. Date: Dec. 10, 2009

(65) Prior Publication Data

US 2011/0086534 A1 Apr. 14, 2011

(30) Foreign Application Priority Data

Jun. 6, 2008 (SG) ..... 200804324-2

(51) Int. Cl.
*H01R 4/50* (2006.01)

(52) U.S. Cl.
USPC ..... 439/345

(58) Field of Classification Search
USPC ..... 439/638, 345, 369, 359, 373
See application file for complete search history.

(56) References Cited

U.S. PATENT DOCUMENTS

| | | | | |
|---|---|---|---|---|
| 3,544,951 | A * | 12/1970 | Roberts | 439/358 |
| 6,375,486 | B1 | 4/2002 | Yu | |
| 6,648,695 | B1 | 11/2003 | Wu | |
| 6,762,615 | B2 | 7/2004 | Lee et al. | |
| 6,908,330 | B2 | 6/2005 | Garrett et al. | |
| 6,945,822 | B2 * | 9/2005 | Flemming et al. | 439/638 |
| 7,238,054 | B2 | 7/2007 | Higeta et al. | |
| 7,829,322 | B2 * | 11/2010 | Kodama et al. | 435/252.31 |
| 2004/0023559 | A1 | 2/2004 | Wu | |
| 2010/0105249 | A1 | 4/2010 | Bandhu et al. | |

FOREIGN PATENT DOCUMENTS

| | | |
|---|---|---|
| JP | 09-097656 | 4/1997 |
| JP | 10-038972 | 2/1998 |
| KR | 20-2000-0015116 | 3/2000 |
| KR | 10-2002-0072446 | 9/2002 |

OTHER PUBLICATIONS

International Search Report for PCT/US2009/043522, pp. 3.
Supplementary EP Search Report, EP 09 75 8933, 2 pp.

* cited by examiner

*Primary Examiner* — Phuong Dinh
(74) *Attorney, Agent, or Firm* — Robert S. Moshrefzadeh

(57) ABSTRACT

A device for securing a first electrical connector to a second electrical connector, comprising a bracket body; and at least one engaging portion extending from the bracket body to the second electrical connector and coupling to a portion of the second electrical connector. Also provided is a method of securing one electrical connector to another electrical connector and an interconnect system comprising a first connector, a second connector, a third connector, and an engaging device.

9 Claims, 10 Drawing Sheets

ELECTRICAL ENGAGEMENT APPARATUS, SYSTEM AND METHOD

CROSS REFERENCE TO RELATED APPLICATIONS

This application is a national stage filing under 35 U.S.C. 371 of PCT/US2009/043522, filed May 12, 2009, which claims priority to Singapore Application No. 200804324-2, filed Jun. 6, 2008, the disclosure of which is incorporated by reference in its/their entirety herein.

TECHNICAL FIELD

The present invention relates to a device and in particular to a device for securing one electrical connector to another.

BACKGROUND

Hard disk drives (HDDs) are used to store digital data content for laptops, desktop computers, servers and other electronic devices in use today.

Every HDD interface communicates with the rest of the computer via the computer input/output (I/O) bus. The interface is the communication channel over which the data flows as the data is read from or written to the HDD. There are many types of HDD interfaces and they include Integrated Drive Electronics (IDE), Advanced Technology Attachment (ATA), Small Computer System Interface (SCSI), Serial ATA (SATA), Serial Attached SCSI (SAS), and Fibre Channel. The list of HDD interfaces described in this section is not exhaustive and is constantly increasing to keep pace with the ever changing demands of the electronic devices which dictate the specifications of the HDDs and their interfaces.

The SATA interface and the SAS interface are the two most commonly adopted interfaces in the HDD industry today. The SATA headers are often used on HDDs that are fitted with laptops and desktop computers while the SAS headers are used on HDDs fitted with enterprise server systems.

Available in the market today are specialized production test equipment used for testing the HDDs' reliability before the HDDs are released for sale. However, most of these test equipments are designed specifically for HDDs with a specific type of interface.

Also, the repeated mating and un-mating of the header on the HDD with the socket on the HDD production test equipment wears out the socket on the HDD production test equipment after a pre-defined number of cycles dependent on the specification of the socket on the HDD production test equipment. The replacement of the socket on the HDD production test equipment is often tedious and time-consuming resulting in HDD production downtime.

To solve the two problems cited, an intermediate connector (henceforth referred to as sacrificial connector) is used to couple the header on the HDD to the socket on the HDD production test equipment by mating the header on the HDD to the socket end of the sacrificial connector and mating the socket on the HDD production test equipment to the header end of the sacrificial connector. Since the connection and disconnection of the HDD to the HDD production test equipment is now via the sacrificial connector, any wear and tear due to repeated mating and un-mating action will happen on the sacrificial connector instead of the socket on the HDD production test equipment.

Along with this solution comes the need to secure the sacrificial connector to the socket on the HDD production test equipment during the mating and un-mating of the HDD to/from the HDD production test equipment via the sacrificial connector.

It would be desirable to provide a device that can be used to secure one connector to another connector easily.

SUMMARY

In accordance with one embodiment of the invention, there is provided a device for securing a first electrical connector to a second electrical connector, comprising a bracket body which at least partially envelops the first electrical connector; and at least one engaging portion extending from the bracket body to the second electrical connector and coupling to a portion of the second electrical connector.

In accordance with another embodiment of the invention, there is provided a device for securing an intermediate electrical connector to an electrical connector on a printed circuit board, comprising a bracket body which at least partially envelops the intermediate electrical connector; and at least one engaging portion extending from the bracket body to the electrical connector on the printed circuit board and coupling to a portion of the electrical connector on the printed circuit board.

In accordance with another embodiment of the invention, there is provided a method of securing one electrical connector to another electrical connector, the method comprising coupling a first electrical connector to a second connector; and using a device to secure the first electrical connector to the second electrical connector wherein the device comprises a bracket body and at least one engaging portion extending from the bracket body such that when the device is fitted with the first connector, the bracket body at least partially envelops the first connector and the engaging portion extends to the second electrical connector and couples to a portion of the second electrical connector.

In accordance with another embodiment of the invention, there is provided an interconnect system comprising a first connector, a second connector, a third connector and an engaging device, wherein the first connector mates with the second connector at a first end of the second connector and the third connector mates with the second connector at a second end of the second connector and the engaging device secures the second connector to the third connector; and wherein the engaging device further comprises a bracket body and at least one engaging portion extending from the bracket body such that when the engaging device is fitted with the second connector, the bracket body at least partially envelops the second connector and the engaging portion extends to the third connector and couples to a portion of the third connector.

The invention may further be described in any alternative combination of parts or features mentioned herein or shown in the accompanying drawings. Known equivalents of these parts or features which are not expressly set out are nevertheless deemed to be included.

BRIEF DESCRIPTION OF THE DRAWINGS

An exemplary form of the present invention will now be described with reference to the accompanying drawings in which.

DETAILED DESCRIPTION

Figure 1:
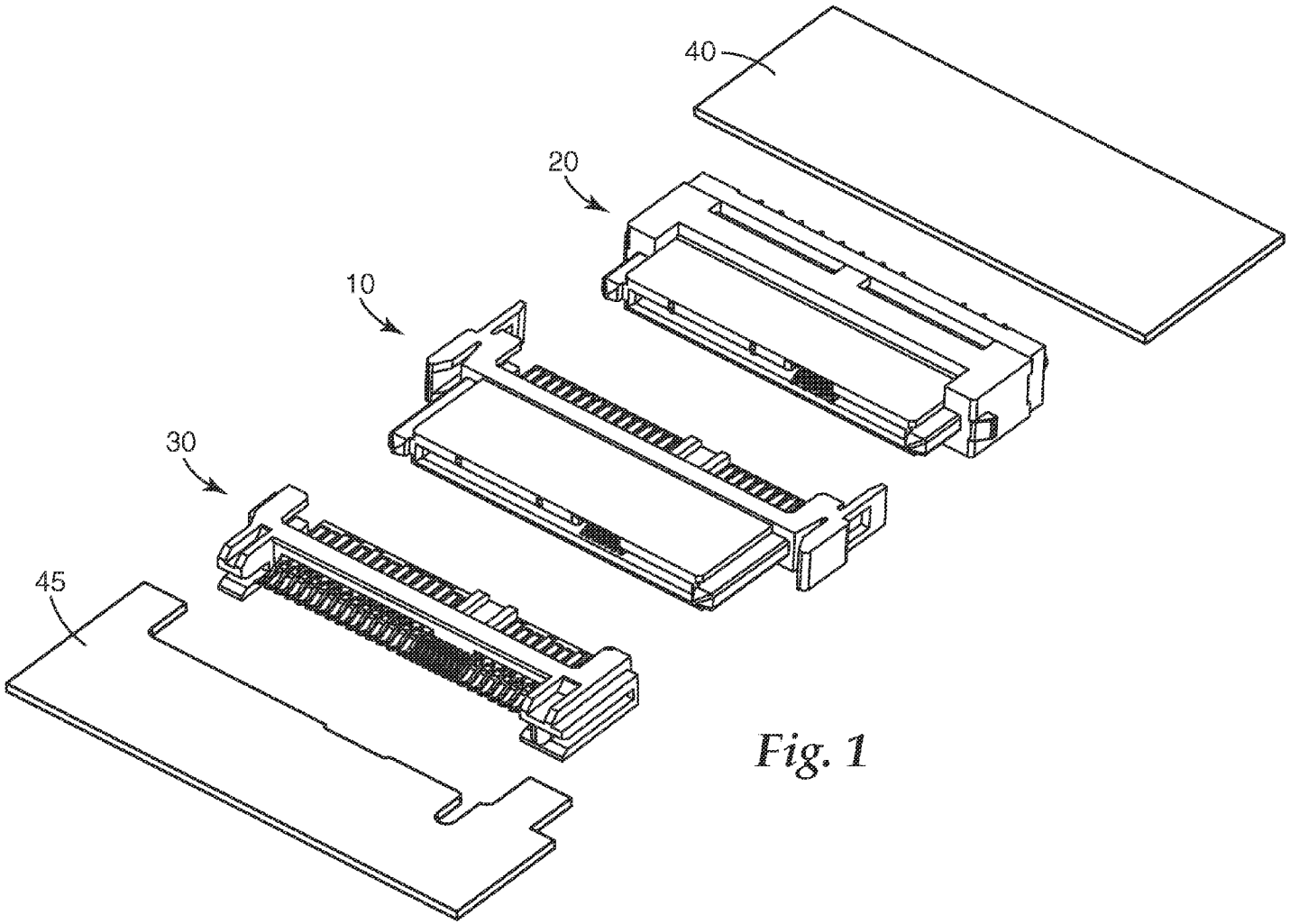
FIG. 1 shows a sacrificial connector in relation to a first complementary connector that is intended to be coupled to a backplane printed circuit board (PCB) of a hard disk drive (HDD) production test equipment and to a second complementary connector that is intended to be coupled to another printed circuit board (PCB) which is further coupled to a HDD.
Figure 2:
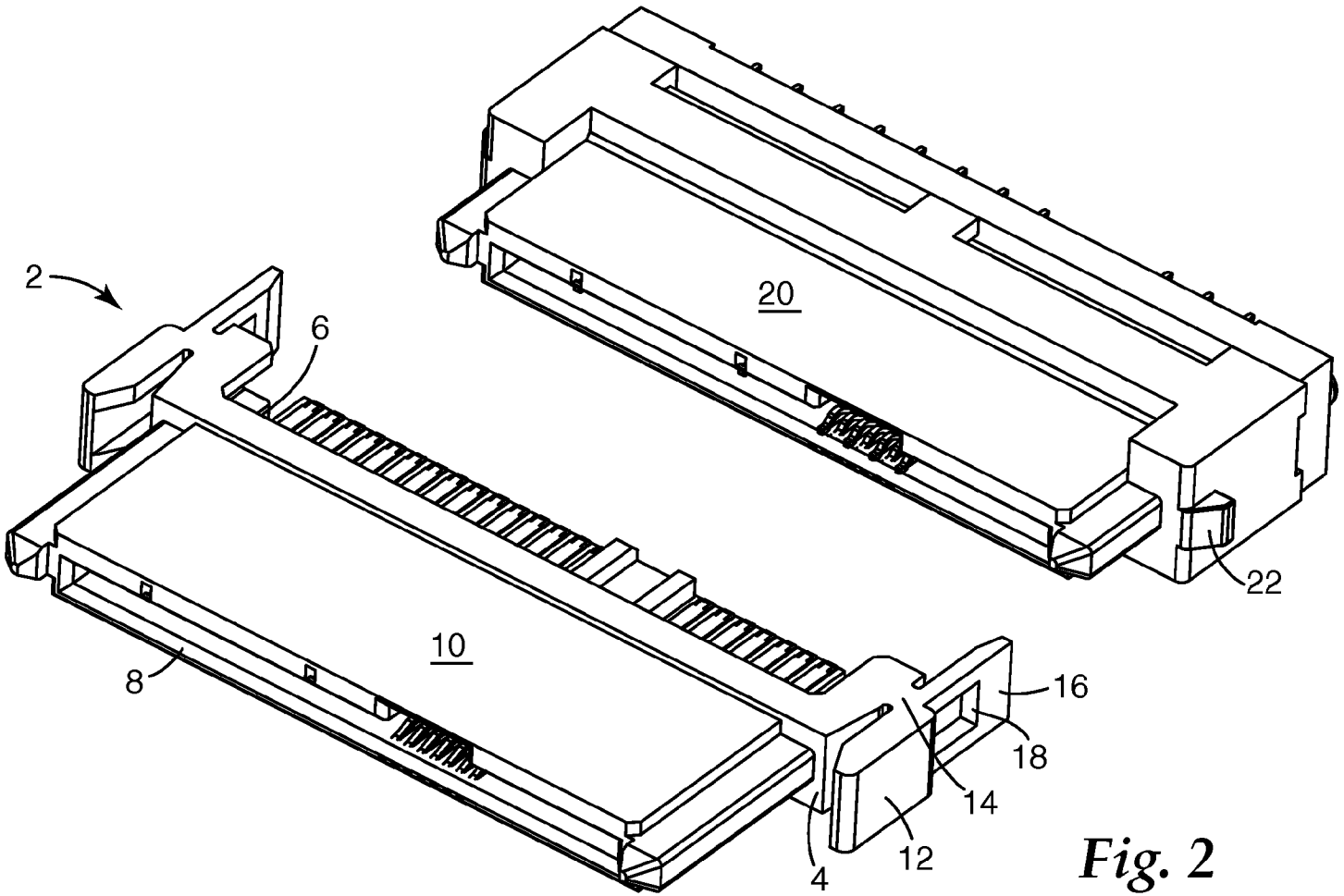
FIG. 2 shows the sacrificial connector in relation to the first complementary connector.

FIG. 1 shows a sacrificial connector 10 in relation to a first complementary connector 20 that is intended to be coupled to a backplane printed circuit board (PCB) 40 of a hard disk drive (HDD) production test equipment (not shown) and to a second complementary connector 30 that is intended to be coupled to a PCB 45 which is further coupled to a HDD (not shown). This is disclosed in the Singapore Application Serial No. 200701728-8, 'Connector Apparatus'. FIG. 2 shows the sacrificial connector 10 in relation to the first complementary connector 20. For illustration purposes, in both FIGS. 1 and 2, the first complementary connector 20 is represented as a socket and the second complementary connector 30 is represented as a header.

In absence of the sacrificial connector 10, the second complementary connector 30 which is coupled to a HDD via the PCB 45 has to be plugged directly into the first complementary connector 20 which is coupled to the HDD production test equipment via the PCB 40 before any test sequences on the HDD production test equipment can be executed on the connected HDD. The second complementary connector 30 is then unplugged from the first complementary connector 20 when the test sequences are completed. Each plugging and unplugging of the second complementary connector 30 to and from the first complementary connector 20 is known as a mating cycle.

The performance of the first complementary connector 20 on the PCB 40 drops with increased mating cycles. The first complementary connector 20 on the PCB 40 is replaced as soon as the number of mating cycles reaches the number specified by the manufacturer of the first complementary connector 20. To replace the first complementary connector 20 on the PCB 40, one has to de-solder the first complementary connector 20 from the PCB 40 and then re-solder a new connector to the PCB 40 before a HDD can be coupled to the HDD production test equipment for testing. This is time consuming and repeated de-soldering and re-soldering of the first complementary connector 20 from and to the PCB 40 may damage the PCB 40.

The sacrificial connector 10 prolongs the useful life of the first complementary connector 20 by being the interface between the first complementary connector 20 and the second complementary connector 30. Since the mating and un-mating of the second complementary connector 30 is now with the sacrificial connector 10, any wear and tear due to repeated mating and un-mating action will happen on the sacrificial connector instead of the first complementary connector 20 on the PCB 40 of the HDD production test equipment. Along with this solution comes the need to secure the sacrificial connector 10 to the first complementary connector 20 on the PCB 40 of the HDD production test equipment so as to prevent any disengagement of the sacrificial connector 10 from the first complementary connector 20 during the mating and un-mating of the second complementary connector 30 with the sacrificial connector 10. Preferably, the sacrificial connector 10 can be secured to the first complementary connector 20 to the extent of withstanding a disengagement force of at least 4 Newtons (N). Here, the disengagement force refers to the force required to disengage the sacrificial connector 10 from the first complementary connector 20.

For illustration purposes, the sacrificial connector 10 as illustrated in FIG. 2 comprises an elongated insulative housing 2 with a longitudinal base 4 and a plurality of contacts received in the housing 2. The housing 2 forms a first mating surface 6 and a second mating surface 8. Since the first complementary connector 20 is a socket at its mating surface and the second complementary connector 30 is a header at its mating surfaces, the sacrificial connector 10 has a header at the first mating surface 6 and a socket at the second mating surface 8.

At each end of the sacrificial connector 10 is a bonding device 14. The bonding device 14 may be any device that is able to temporarily hold the sacrificial connector 10 in place with respect to the first complementary connector 20 at the first mating surface 6 as the second complementary connector 30 is plugged and unplugged to and from the sacrificial connector 10 at the second mating surface 8 during each mating cycle.

The bonding device 14 as illustrated in FIG. 2 is a latching device with a latch release 12, a latch member 16 extending in the direction of the first mating surface 6 and a hole 18 in the latch member 16. As the sacrificial connector 10 engages with the first complementary connector 20 at the first mating surface 6, a protrusion 22 coupled to an end wall on the first complementary connector 20 pushes the latch member 16 outwards away from the end wall of the first complementary connector 20 as the latch member 16 rides over the slope of protrusion 22. As the latch member 16 passes the ridge of the protrusion 22, the hole 18 in the latch member 16 engages with the protrusion 22 of the first complementary connector 20 causing the latch member 16 to fall back to its original horizontal position. This is the locked position of the latching device and the sacrificial connector 10 is engaged to the first complementary connector 20. To disengage the sacrificial connector 10 from the first complementary connector 20, the latch release 12 is depressed inwards towards the housing 2 of the sacrificial connector 10. In doing so, the hole 18 in the latch member 16 disengages with the protrusion 22 on the first complementary connector 20, and the two connectors 10, 20 can be easily disengaged by pulling the sacrificial connector 10 in a direction away from the first complementary connector 20.

In cases where there is no bonding device 14 coupled to the sacrificial connector 10 and/or in cases where there is no corresponding device on the first complementary connector 20 to engage with the bonding device 14 on the sacrificial connector 10 such as to secure the sacrificial connector 10 to the first complementary connector 20 during the un-mating of the second complementary connector 30 from the sacrificial connector 10, there is a need to have a separate engagement device to secure the sacrificial connector 10 to the first complementary connector 20.

Figure 3:
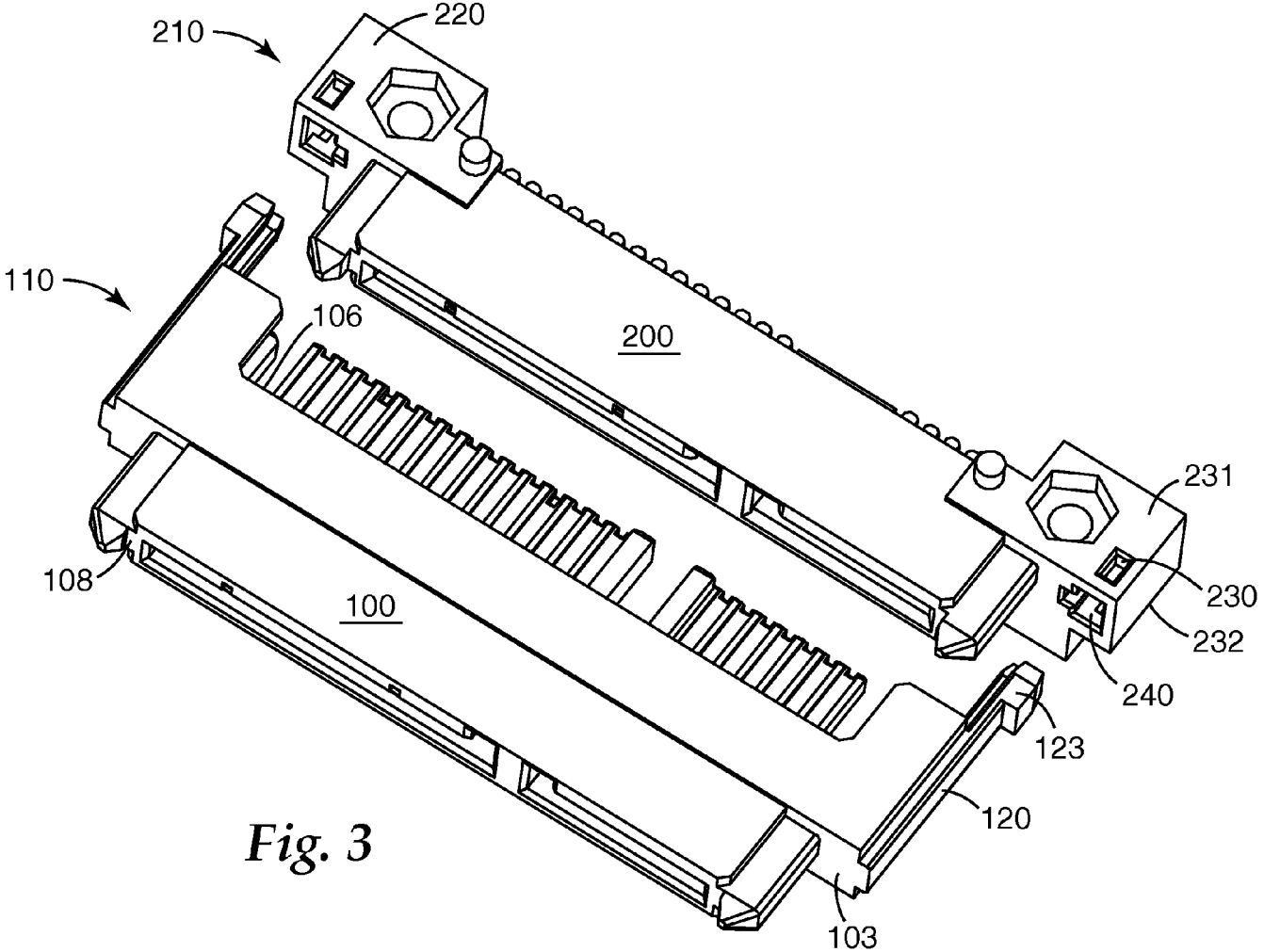
FIG. 3 shows another sacrificial connector in relation to another first complementary connector.

FIG. 3 shows another sacrificial connector 100 in relation to another first complementary connector 200. The sacrificial connector 100 comprises an elongated insulative housing 110 with a longitudinal base 103 and a plurality of contacts received in the housing 110. The housing 110 forms a first mating surface 106 and a second mating surface 108.

At one end of the housing 110 of the sacrificial connector 100 is a housing extension 120 which further comprises a hook 123 at one end of the housing extension 120 furthest from the second mating surface 108. Preferably, there is one housing extension 120 at each end of the housing 110 of the sacrificial connector 100.

The first complementary connector 200 comprises a housing 210 wherein at one end of the housing 210 is a housing protrusion 220. Preferably, there is one housing protrusion 220 at each end of the housing 210 of the first complementary connector 200. The housing protrusion 220 further comprises a horizontal through-hole 240 which is in alignment with the housing extension 120 of the sacrificial connector 100 and a vertical tunnel 230. It is preferred but not mandatory that the tunnel 230 be made perpendicular to the through-hole 240. Preferably the tunnel 230 extends from a first surface 231 of the housing protrusion 220 to a second surface 232 of the housing protrusion 220.

Figure 4:
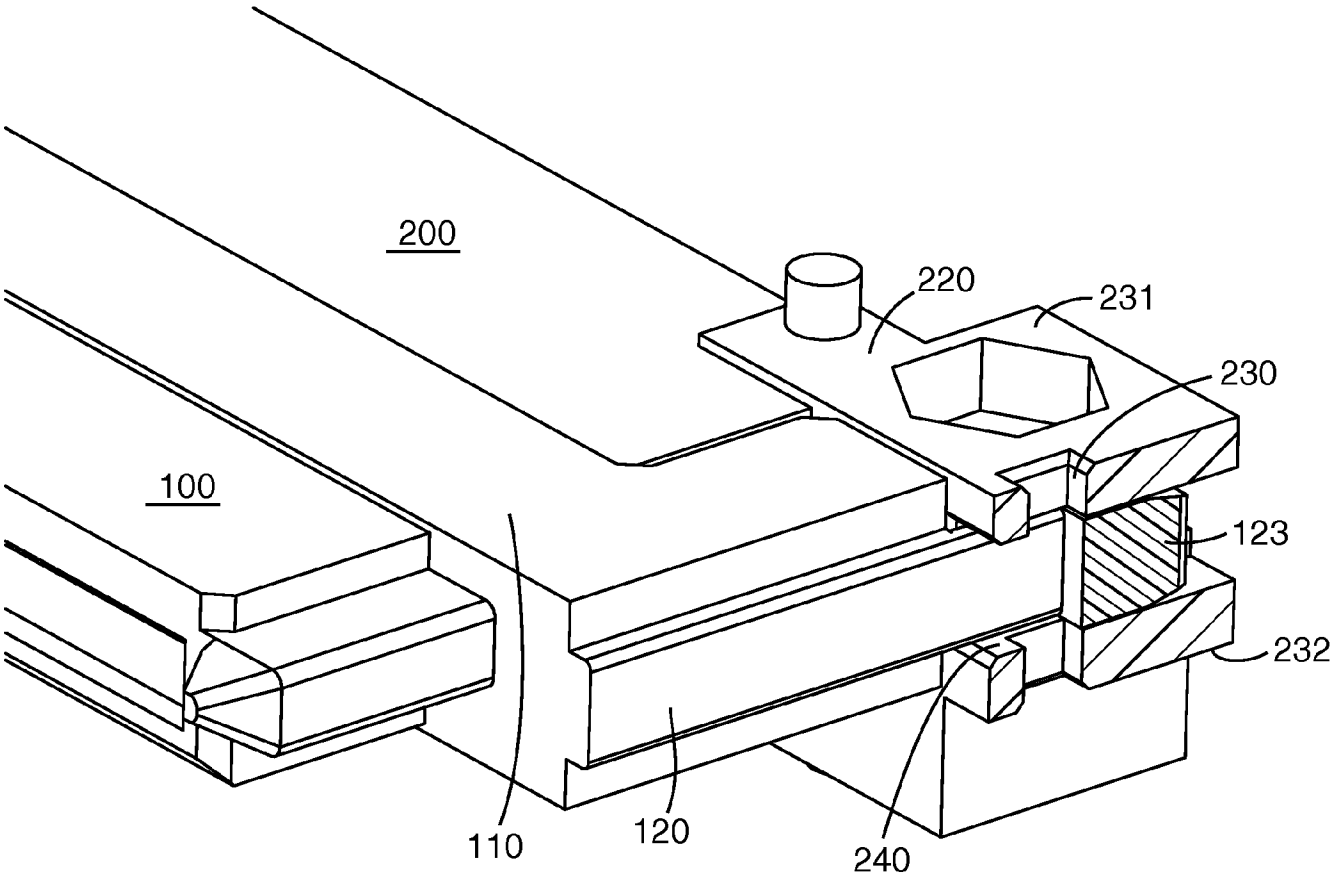
FIG. 4 shows a close-up cutaway view of a vertical cross-section of a housing protrusion with the sacrificial connector and the first complementary connector in an engaged position.

FIG. 4 shows a close-up view of a vertical cross-section of the housing protrusion 220 with the sacrificial connector 100 and the first complementary connector 200 in an engaged position. While there is frictional resistance at the areas of contact between the housing extension 120 of the sacrificial connector 100 and the through-hole 240 of the housing protrusion 220 of the first complementary connector 200, the frictional resistance may not be sufficient to prevent the disengagement of the sacrificial connector 100 from the first complementary connector 200 during the un-mating of the second complementary connector (not shown) from the sacrificial connector 100, especially when the disengagement force is greater than 4 Newtons (N). Here, the disengagement force refers to the force required to disengage the sacrificial connector 100 from the first complementary connector 200.

Figure 5:
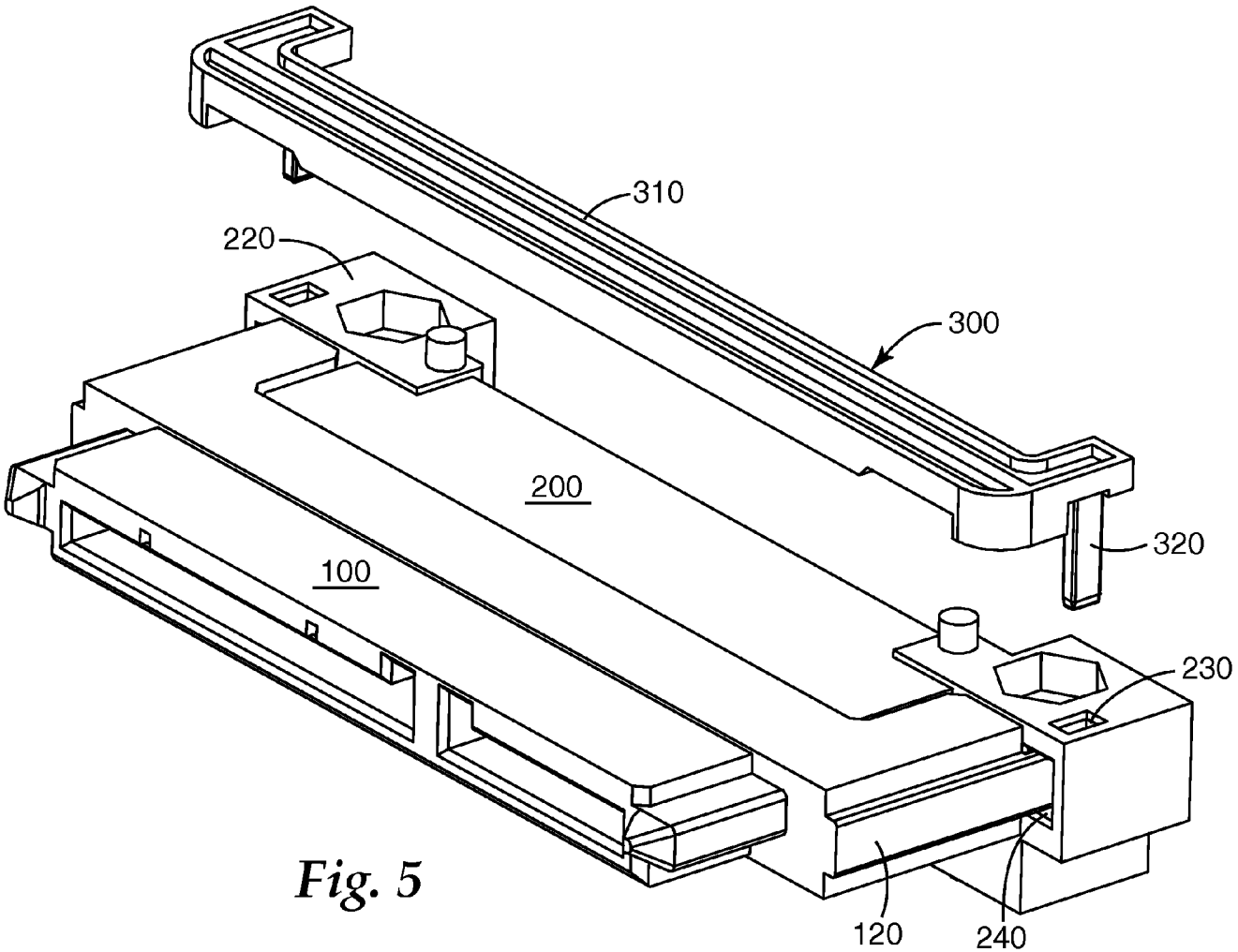
FIG. 5 is a perspective view of an exemplary engagement device of the present invention in position before engagement with the first complementary connector mated with the sacrificial connector.

FIG. 5 is a perspective view of an exemplary engagement device 300 of the present invention in position before engagement with the first complementary connector 200 that is engaged with the sacrificial connector 100. The engagement device 300 comprises a bracket body 310 which at least will partially envelop the sacrificial connector 100 once it is engaged and at least one engaging portion 320 extending from the bracket body 310 to the first complementary connector 200 and coupling to a portion of the first complementary connector 200.

Figure 6A:
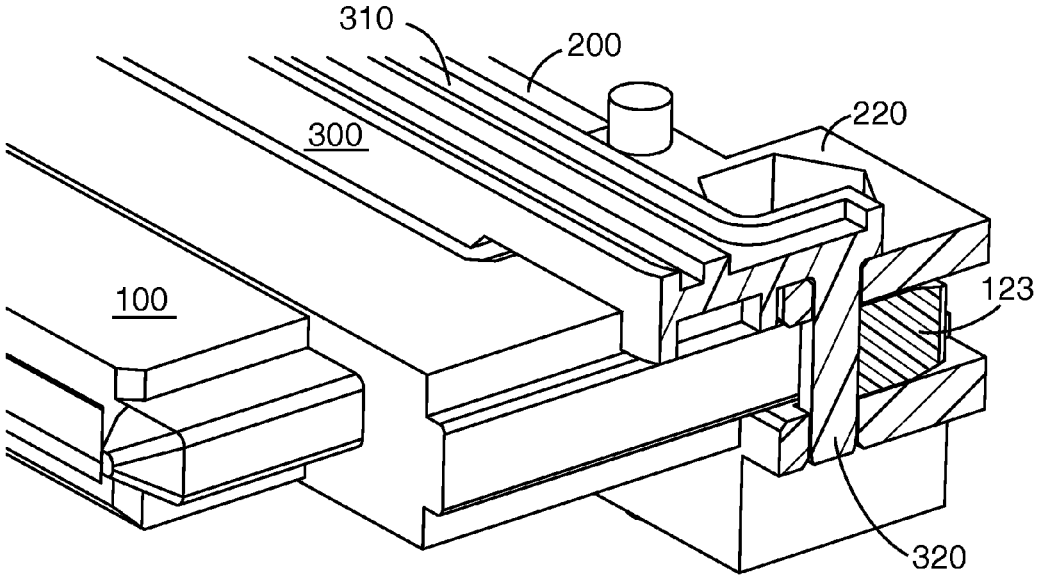
FIG. 6A shows a close-up side perspective view of a vertical cross-section of the housing protrusion with the engagement device of the present invention, the sacrificial connector and the first complementary connector in an engaged position.
Figure 6B:
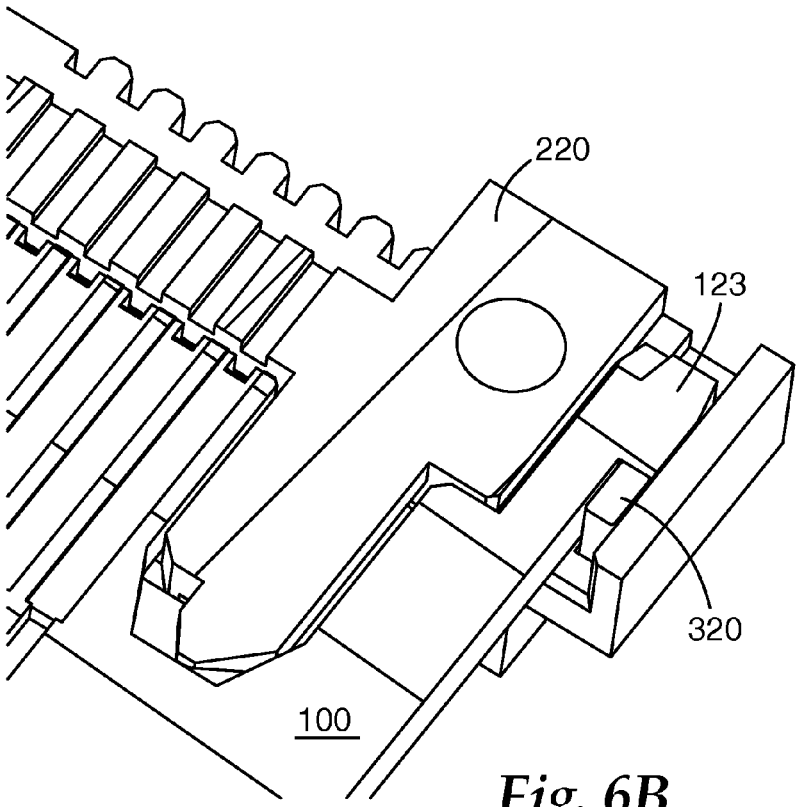
FIG. 6B shows a close-up top view of a horizontal cross-section of the housing protrusion with the engagement device of the present invention, the sacrificial connector and the first complementary connector in an engaged position.

FIG. 6A shows a close-up side view of a vertical cross-section of the housing protrusion 220 with the engagement device 300, the sacrificial connector 100 and the first complementary connector 200 in an engaged position. FIG. 6B shows a close-up top view of a horizontal cross-section of the housing protrusion 220 with the engagement device 300, the sacrificial connector 100 and the first complementary connector 200 in an engaged position. When in an engaged position, the engaging portion 320 of the engagement device 300 fits into the tunnel 230 of the housing protrusion 220 as illustrated by FIG. 6A. Without the engagement device 300, during the un-mating of the second complementary connector (not shown) from the sacrificial connector 100, the disengagement force, typically greater than 4 Newtons (N), may be exerted on the sacrificial connector 100 causing the sacrificial connector 100 to be disengaged from the first complementary connector 200. However, when the engaging device 300 is engaged with the sacrificial connector 100 and the first complementary connector 200, the engaging portion 320 of the engagement device 300 will obstruct the movement of the hook 123 thereby preventing the movement of the housing extension 120 of the sacrificial connector 100 and thus, preventing the sacrificial connector 100 from disengaging with the first complementary connector 200.

Figure 7A:
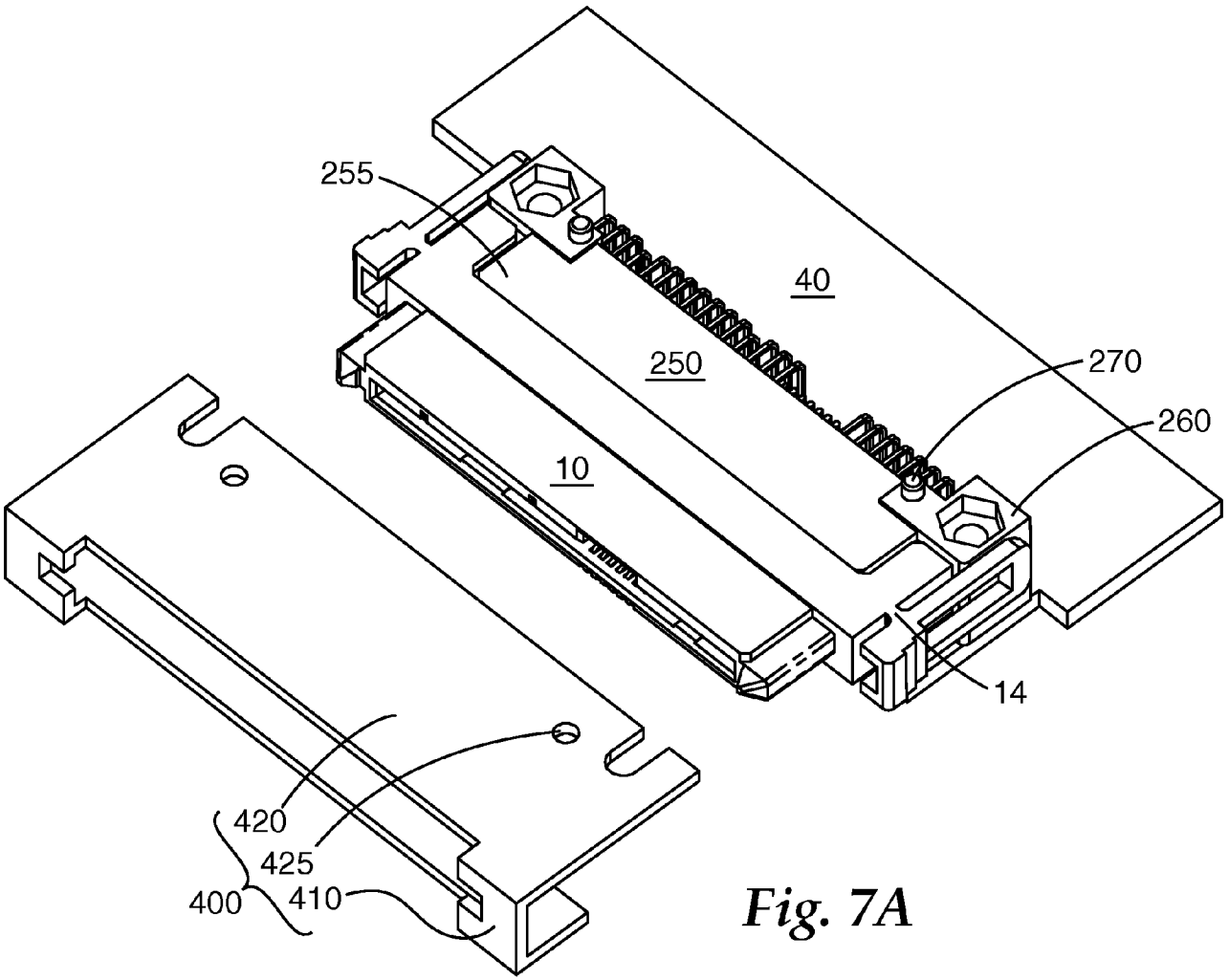
FIG. 7A is a perspective view of another exemplary engagement device of the present invention in position before engagement with another first complementary connector coupled to the printed circuit board (PCB) mated with the sacrificial connector.

FIG. 7A is a perspective view of another exemplary engagement device 400 of the present invention in position before engagement with the sacrificial connector 10 which is engaged to another first complementary connector 250 that is coupled to the printed circuit board (PCB) 40. As illustrated in FIG. 7A, the sacrificial connector 10 has a bonding device 14 coupled to each end of the sacrificial connector 10. The first complementary connector 250 comprises a housing 255, a housing protrusion 260 coupled to both ends of the housing 255 and at least one knob 270 extending from the housing 255. As there is no corresponding device on the first complementary connector 250 to engage with the bonding device 14 on the sacrificial connector 10, the sacrificial connector 10 may disengage from the first complementary connector 250 during the un-mating of the second complementary connector (not shown) from the sacrificial connector 10.

Figure 7B:
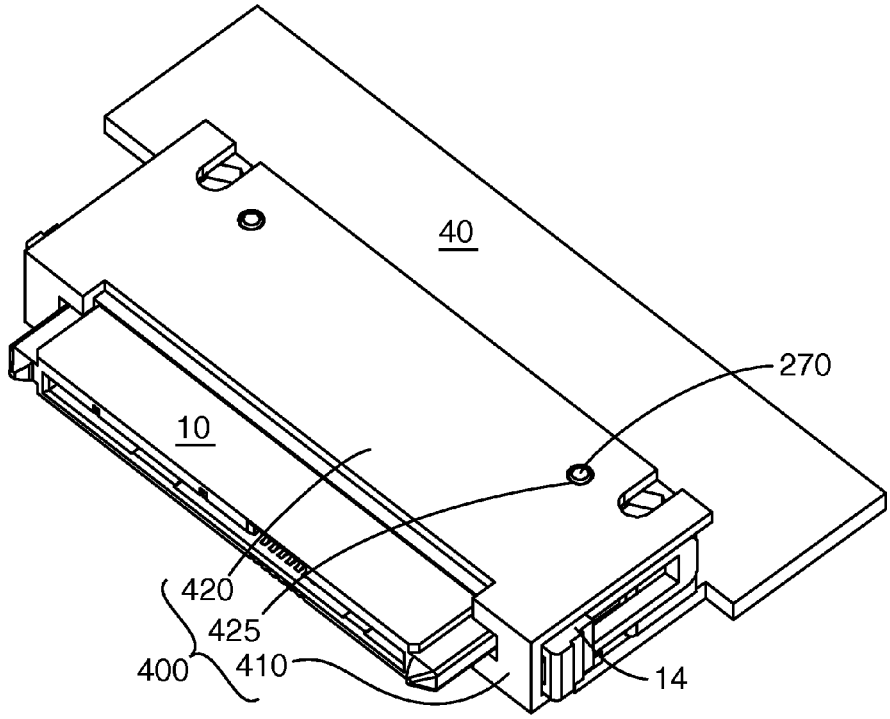
FIG. 7B shows the engagement device engaged with the sacrificial connector and the first complementary connector.
Figure 7C:
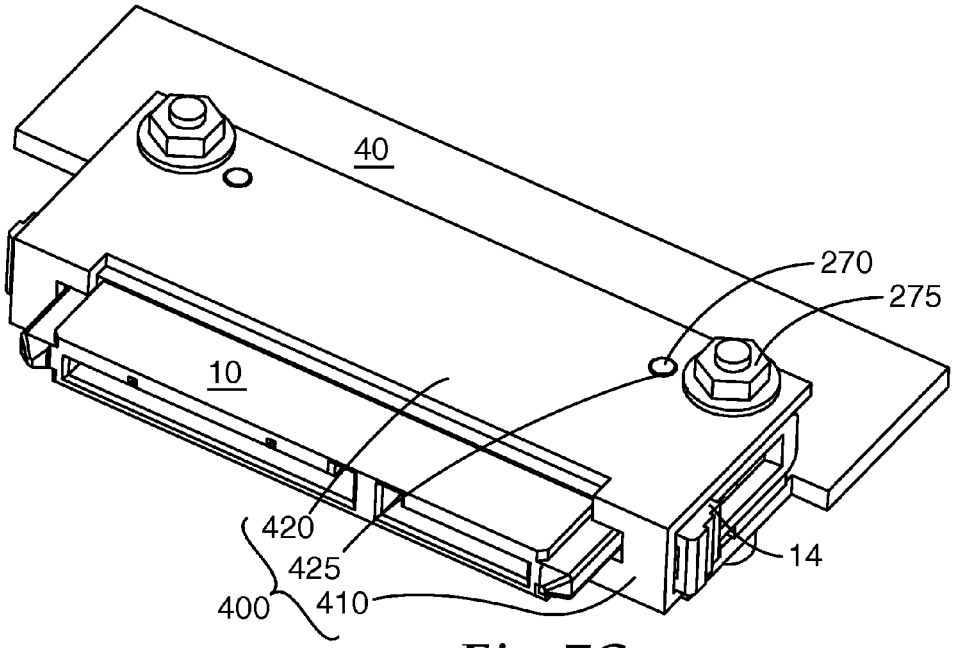
FIG. 7C shows the engagement device engaged with the sacrificial connector and the first complementary connector further secured with a plurality of securing devices.

The engagement device 400 as shown in FIG. 7A comprises a bracket body 410 which at least will partially envelop the sacrificial connector 10 once it is engaged and at least one engaging portion 420 extending from the bracket body 410 to the first complementary connector 250. The engagement device 400 further comprises at least one hole 425 on the engaging portion 420 which is positioned according to and will couple to at least one knob 270 on the housing 255 of the first complementary connector 250 when the engagement device 400 is engaged with the sacrificial connector 10 and the first complementary connector 250. Preferably, there is more than one knob 270 extending from the housing 255 and more than one hole 425 on the engaging portion 420 of the engagement device 400. FIG. 7B shows the engagement device 400 engaged with the sacrificial connector 10 and the first complementary connector 250. FIG. 7C shows the engagement device 400 further secured to the first complementary connector 250 by at least one securing device 275 such as but not limited to screws. While it is shown in FIGS. 7A, 7B and 7C that there is a bonding device 14 coupled to the two ends of the sacrificial connector 10, it is possible to do away with the bonding device 14 in this case since there is no corresponding device on the first complementary connector 250 to engage with the bonding device 14.

Figure 8A:
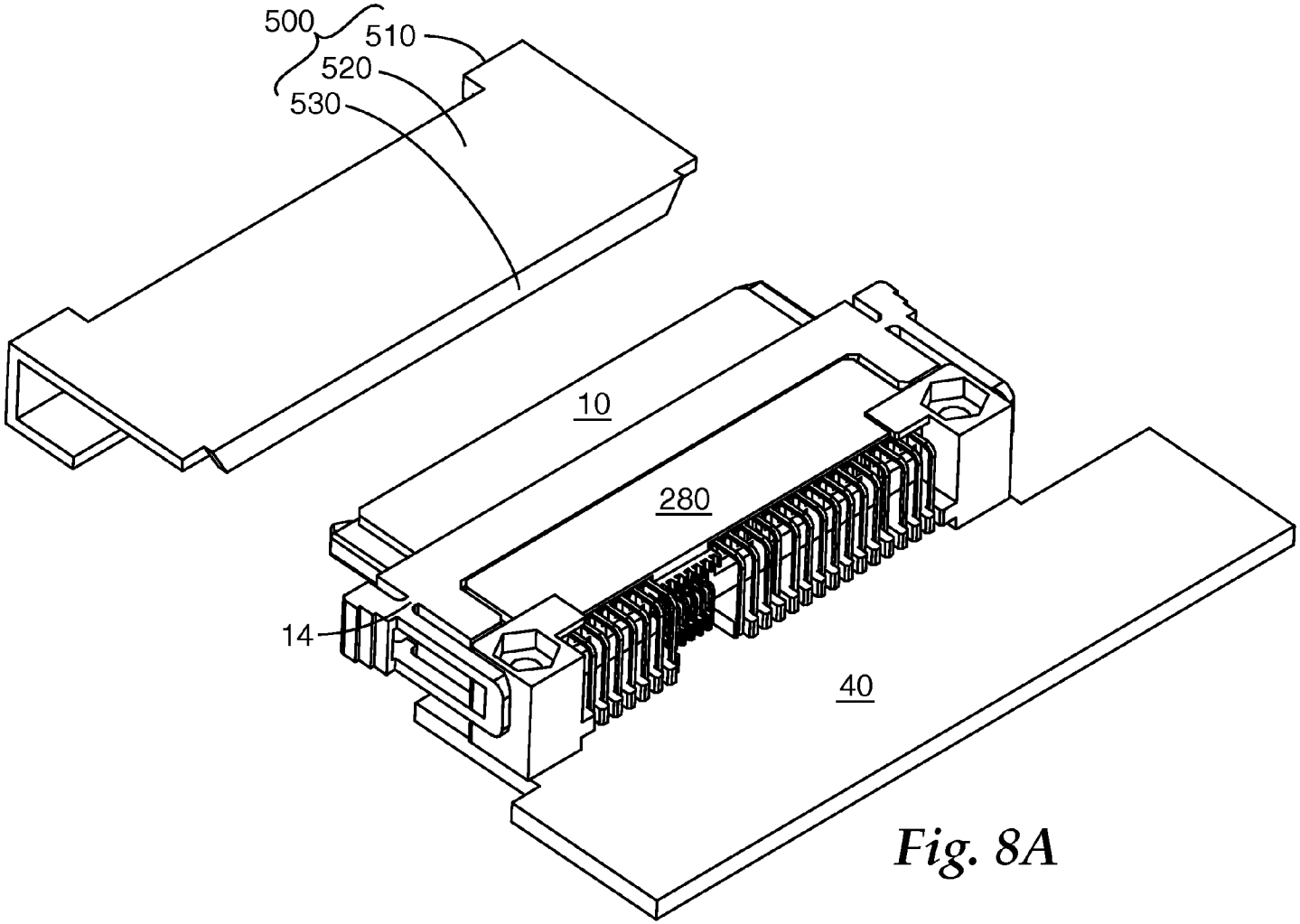
FIG. 8A is a perspective view of another exemplary engagement device of the present invention in position before engagement with another first complementary connector coupled to the printed circuit board (PCB) mated with the sacrificial connector.
Figure 8B:
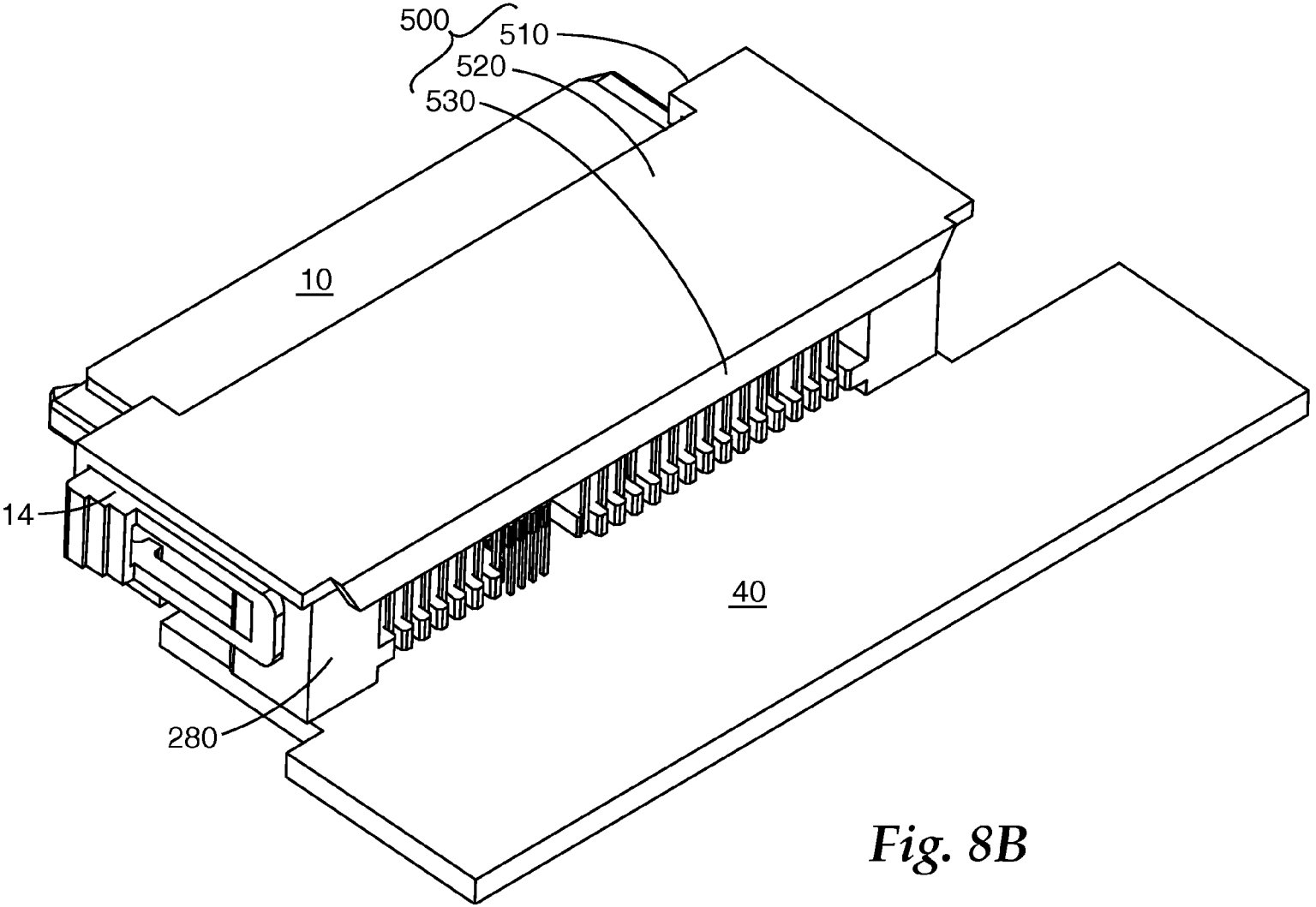
FIG. 8B shows the engagement device engaged with the sacrificial connector and the first complementary connector.

FIG. 8A is a perspective view of another exemplary engagement device 500 of the present invention in position before engagement with the sacrificial connector 10 engaged to another first complementary connector 280 coupled to the printed circuit board (PCB) 40. The engagement device 500 comprises a bracket body 510 which at least will partially envelop the sacrificial connector 10 once it is engaged and at least one engaging portion 520 extending from the bracket body 510 to the first complementary connector 280. The engagement device 500 further comprises at least one engagement lip 530 at the end of the engaging portion 520 which will hook over at least one portion on the first complementary connector 280 when the engagement device 500 is engaged with the sacrificial connector 10 and the first complementary connector 280. FIG. 8B shows the engagement device 500 engaged with the sacrificial connector 10 and the first complementary connector 280. While it is shown in FIGS. 8A and 8B that there is a bonding device 14 coupled to the two ends of the sacrificial connector 10, it is possible to do away with the bonding device 14 in this case since there is no corresponding device on the first complementary connector 280 to engage with the bonding device 14.

The foregoing description of the preferred embodiment of the invention has been presented for purposes of illustration and description. It is not intended to be exhaustive or to limit the invention to the precise forms disclosed, since many modifications or variations thereof are possible in light of the above teaching. All such modifications and variations are within the scope of the invention. The embodiments described herein were chosen and described in order best to explain the principles of the invention and its practical application, thereby to enable others skilled in the art to utilize the invention in various embodiments and with various modifications as are suited to the particular use contemplated thereof. It is intended that the scope of the invention be defined by the claims appended hereto, when interpreted in accordance with the full breadth to which they are legally and equitably suited.

The invention claimed is:

1. A sacrificial testing device for securing a first electrical connector mated directly to a second electrical connector, comprising: a bracket body which at least partially envelops the first electrical connector; at least one engaging portion extending from the bracket body to the second electrical connector and coupling to a portion of the second electrical connector; and a retaining feature adapted to hold the sacrificial testing device to the first electrical connector and or to the second electrical connector, wherein the first electrical connector is mated directly to the second electrical connector.

2. The device of claim 1 wherein the bracket body has two or more engaging portions extending from two locations of the bracket body and coupling to two or more portions of the second electrical connector.

3. A device for securing an intermediate sacrificial electrical connector mated directly to an electrical connector on a printed circuit board, comprising:

a bracket body which at least partially envelops the intermediate sacrificial electrical connector; and at least one engaging portion extending from the bracket body to the electrical connector on the printed circuit board and coupling to a portion of the electrical connector on the printed circuit board, wherein the intermediate sacrificial electrical connector is mated directly to the electrical connector on the printed circuit board.

4. The device of claim 3 wherein the bracket body has two or more engaging portions extending from two locations of the bracket body and coupling to two or more portions of the electrical connector on the printed circuit board.

5. A method of securing one electrical connector coupled directly to another electrical connector, the method comprising: coupling a first electrical connector directly to a second electrical connector; and using a device to secure the first electrical connector to the second electrical connector wherein the device comprises a bracket body, a retention feature, and at least one engaging portion extending from the bracket body such that when the device is fitted with the first connector, the bracket body at least partially envelops the first connector and the engaging portion extends to the second electrical connector and couples to a portion of the second electrical connector, and wherein the retaining feature is adapted to hold the device to the first electrical connector and or to the second electrical connector.

6. An interconnect system comprising a first connector, a second connector, a third connector and an engaging device, wherein the first connector mates directly with the second connector at a first end of the second connector and the third connector mates directly with the second connector at a second end of the second connector and the engaging device secures the second connector to the third connector; and wherein the engaging device further comprises a bracket body, a retaining feature adapted to hold the device to the first connector and or to the second connector, and at least one engaging portion extending from the bracket body such that when the engaging device is fitted with the second connector, the bracket body at least partially envelops the second connector and the engaging portion extends to the third connector and couples to a portion of the third connector.

7. The interconnect system of claim 6 wherein the third connector further comprises at least one protrusion on at least one surface of the third connector, the engaging portion of the engaging device further comprises at least one through-hole, and the protrusion on the third connector couples with the through-hole of the engaging portion of the engaging device when the engaging device is in the position that secures the second connector to the third connector.

8. The interconnect system of claim 6 wherein the second connector is bonded to the third connector by a bonding device and the engaging portion of the engaging device couples to the third connector at the location where the second connector is bonded to the third connector.

9. The interconnect system of claim 8 wherein the bonding device is a latching device, the engaging portion of the engaging device is a protrusion and at the location of the third connector where the engaging portion couples to the third connector is a through-hole; and wherein the protrusion fits into the through-hole and engages with the latching device when the engaging device is in the position that secures the second connector to the third connector.

* * * * *